US005896937A

United States Patent [19]

Kaneko

[11] Patent Number: 5,896,937

[45] Date of Patent: Apr. 27, 1999

[54] BUFFER MECHANISM OF HYDRAULIC IMPACT APPARATUS

[75] Inventor: Tsutomu Kaneko, Tochigi, Japan

[73] Assignee: Furukawa Co., Ltd., Japan

[21] Appl. No.: 09/043,158

[22] PCT Filed: Oct. 16, 1996

[86] PCT No.: PCT/JP96/02996

§ 371 Date: Mar. 12, 1998

§ 102(e) Date: Mar. 12, 1998

[87] PCT Pub. No.: WO97/14870

PCT Pub. Date: Apr. 24, 1997

[30] Foreign Application Priority Data

Oct. 16, 1995 [JP] Japan ..... 7-267196

[51] Int. Cl.[6] ..... B25D 17/24

[52] U.S. Cl. ..... 173/211; 173/105; 173/210; 173/135

[58] Field of Search ..... 173/105, 210, 173/211, 212, 138, 17, 206, 135

[56] References Cited

U.S. PATENT DOCUMENTS

| | | | |
|---|---|---|---|
| 4,068,727 | 1/1978 | Andersson et al. | 173/212 |
| 4,222,462 | 9/1980 | Ottestad | 173/210 |
| 4,703,838 | 11/1987 | Roussin et al. | 173/210 |
| 4,993,504 | 2/1991 | Rodert et al. | 173/105 |
| 5,437,339 | 8/1995 | Tanaka | 173/210 |
| 5,479,996 | 1/1996 | Jonsson et al. | 173/212 |

FOREIGN PATENT DOCUMENTS

| | | |
|---|---|---|
| 0389 454 | 9/1990 | European Pat. Off. . |
| 2-262974 | 10/1990 | Japan . |

*Primary Examiner*—Scott A. Smith
*Attorney, Agent, or Firm*—Young & Basile, P.C.

[57] ABSTRACT

The present invention relates to a buffer mechanism of a hydraulic impact apparatus of a rock drill, and the like, and the buffer mechanism reduces damage by buffering the reflected energy from a shank rod (2), and enables to apply impact by advancing a bit so as to contact the rock even when a rock drill main body (1) cannot advance to a predetermined position for lack of thrust before the next application of impact after the rock drill main body once retracted, thereby to improve the efficiency of impact application. In a rock drill including an impact mechanism for applying impact to the shank rod (2), and a chuck driver bush (13) for transmitting thrust to the shank rod (2) to be applied to an object to be crushed, a front damping piston (4) having thrust smaller than thrust of the rock drill main body (1), and a rear damping piston (5) having thrust larger than the thrust of the rock drill main body (1) are provided at the rear of the chuck driver bush (13).

1 Claim, 8 Drawing Sheets

BUFFER MECHANISM OF HYDRAULIC IMPACT APPARATUS

TECHNICAL FIELD

The present invention relates to a buffer mechanism of a hydraulic impact apparatus such as a rock drill, breaker and the like, wherein the hydraulic impact apparatus performs crushing of rock by applying impact to a tool such as a rod, chisel or the like.

BACKGROUND ART

For example, in a rock drill, as shown in FIG. 2, a shank rod 2 is inserted into a front end portion of a rock drill main body 1, and a rod 22 attached with a bit 21 for drilling is connected to the shank rod 2 through a sleeve 23. When an impact piston 31 of an impact mechanism 3 of the rock drill applies impact to the shank rod 2, the impact energy is transmitted from the shank rod 2 to the bit 21 through the rod 22, and the bit 21 crushes rock R which is the object to be crushed by applying the impact.

At this time, since the reflected energy Er is transmitted from the bit 21 to the rock drill main body 1 through the rod 22 and shank rod 2, the rock drill main body 1 is once retracted by the reflected energy Er. Then after the rock drill main body 1 is advanced by thrust of a feed mechanism (not shown) by a crush length of one aplication of impact, the next impact is applied by the impact mechanism 3. The drilling work is performed by repeating this stroke.

A conventional rock drill main body 1 is provided with a chuck driver 12 as shown in FIG. 6 to rotate the shank rod 2 through a chuck 11, and a chuck driver bush 13 which abutts against a large diameter portion rear end 2*b* of the shank rod 2 is fitted into the chuck driver 12. This chuck driver bush 13, when thrust in a forward direction is applied to the rock drill main body 1, transmits this thrust to the shank rod 2, and at the time of impact application, the reflected energy Er from the bit 21 is also transmitted to the rock drill main body 1 from the shank rod 2 through the chuck driver bush 13.

When this reflected energy Er is directly transmitted to the rock drill main body 1 by the chuck driver bush 13, there is a fear of causing damage in the rock drill due to its impact. Accordingly, as shown in FIG. 7, some rock drills are provided with a damping piston 50 at the rear side of the chuck driver bush 13 as a buffer mechanism for buffering the reflected energy Er.

As described above, the rock drill main body 1 is once retracted after one impact application, and after it is advanced by the thrust by the crush length of one impact application, the rock drill main body 1 must perform the next application of impact. Thus, after once retracted, it is necessary to advance the rock drill main body 1 quickly by the crush length of one impact application before the next impact is applied.

When the advance is insufficient, the position of the shank rod 2 is not definite, and as shown in FIG. 8, since the bit 21 is spaced from the rock R, the impact energy of the impact piston 31 is not transmitted to the rock R, and the crushing work will not be performed. At this time, almost all the impact energy becomes the reflected energy Er and returns to the rock drill main body 1 so that not only the wear or the tools such as rod 22, bit 21, sleeve 23, etc., is increased but also a strong retracting force is exerted to the rock drill main body 1 resulting in further delay in advancement for the next application of impact.

However, usually, the strength of the reflected energy received by the hydraulic impact apparatus is different for each application of impact, and accordingly, the amount of retraction of the hydraulic impact apparatus is not uniform with large variations depending on the nature of the rock. Furthermore, a reaction force to the hydraulic impact apparatus due to the advance and retraction of the impact piston is added to the retraction force.

DISCLOSURE OF THE INVENTION

In the conventional hydraulic impact apparatus, it is impossible to appropriately deal with the variations in the reflected energy and in the amount of retraction, and some times the delay is caused in the advance movement for the next application of impact. This delay in the advance movement cannot be dealt with by only buffering the reflected energy.

The present invention solves the problems mentioned above in the hydraulic impact apparatus, and provides a hydraulic impact apparatus in which the reflected energy from the tool is transmitted to the hydraulic impact apparatus by buffering by an oil pressure thereby to reduce the damage, and at the same time, even when the advance to a predetermined position of the apparatus main body cannot be achieved due to insufficient thrust of the hydraulic impact apparatus before the next application of impact after the hydraulic impact apparatus is once retracted, it is possible to advance so that the tool is in contact with the rock and to apply the impact, thereby to improve the impact application efficiency.

In the present invention, in the hydraulic impact apparatus including an impact mechanism for applying impact to a tool, and a transmission member for transmitting to the tool the thrust which is applied to an object side to be crushed, there are provided at the rear of the transmission member with a front damping piston having thrust smaller than that of the apparatus main body of the hydraulic impact apparatus, and a rear damping piston having thrust larger than that of the apparatus main body to constitute a buffer mechanism thereby to solve the above-mentioned problems.

In the hydraulic impact apparatus, when the impact mechanism applies the impact to the tool, the tool strikes the object to be crushed to crush it.

At this time, since the reflected energy is transmitted to the hydraulic impact apparatus from the tool through the transmission member, the hydraulic impact apparatus is once retracted, and after the hydraulic impact apparatus is advanced by a crush length of one application of impact due to the thrust exerted thereon, the impact mechanism performs the next application of impact.

Here, since the reflected energy from the tool is buffered by the retraction of the front damping piston and the rear damping piston, the damage of the apparatus main body and the tool of the hydraulic impact apparatus is reduced.

Since the thrust of the rear damping piston is larger than the thrust of the apparatus main body of the hydraulic impact apparatus, the front damping piston and the rear damping piston are advanced quickly to a predetermined front end position of the rear damping piston. Although the thrust of the front damping piston is smaller than the thrust of the appatatus main body, since the mass of the transmission member and the tool is far smaller than that of the apparatus main body of the hydraulic impact apparatus, thereafter, it is possible to further advance only the transmission member and the tool by the front damping piston. Accordingly, even in the case where the thrust of the hydraulic impact apparatus is insufficient, and the apparatus main body cannot be advanced to a predetermined position before the next application of impact after the apparatus main body has been once retracted, the tool is brought into a state in contact with the rock, and the next application of impact can be performed. Thus, the efficiency of the impact application is improved.

As stated above, in the buffer mechanism of the hydraulic impact apparatus according to the invention, the reflected energy from the tool is transmitted to the hydraulic impact apparatus while being buffered by oil pressure to reduce the damage, and at the same time, even in the case where the thrust of the hydraulic impact apparatus is insufficient, and the apparatus main body cannot be advanced to a predetermined position before the next application of impact after the apparatus main body has been once retracted, the tool can be advanced to a position in contact with the rock and the next application of impact can be performed, so that the efficiency of the impact application can be improved.

BEST MODE FOR CARRYING OUT THE INVENTION

One mode for carrying out the present invention will be described with referernce to the drawings.

Figure 2:
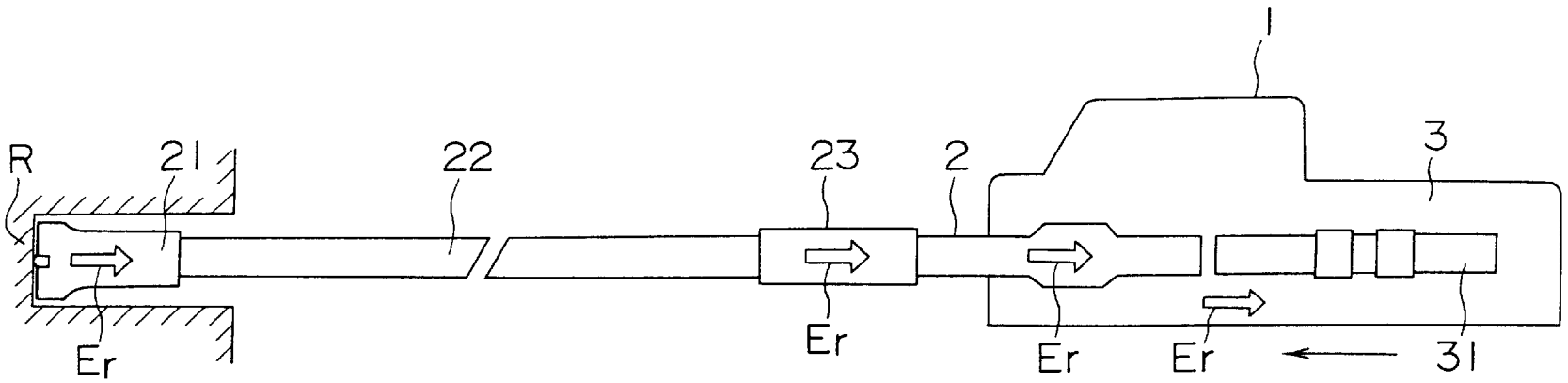
FIG. 2 is a diagram for explaining a basic structure of the rock drill.

Here, the basic structure of a rock drill is the same as that of the conventional rock drill, and as shown in FIG. 2, a shank rod 2 is inserted into a front end portion of the rock drill main body 1, and an impact mechanism 3 for applying impact to the shank rod 2 is provided at the rear of the shank rod 2. A rod 22 having a bit 21 for drilling attached thereto is connected to the shank rod 2 through a sleeve 23.

Figure 1:
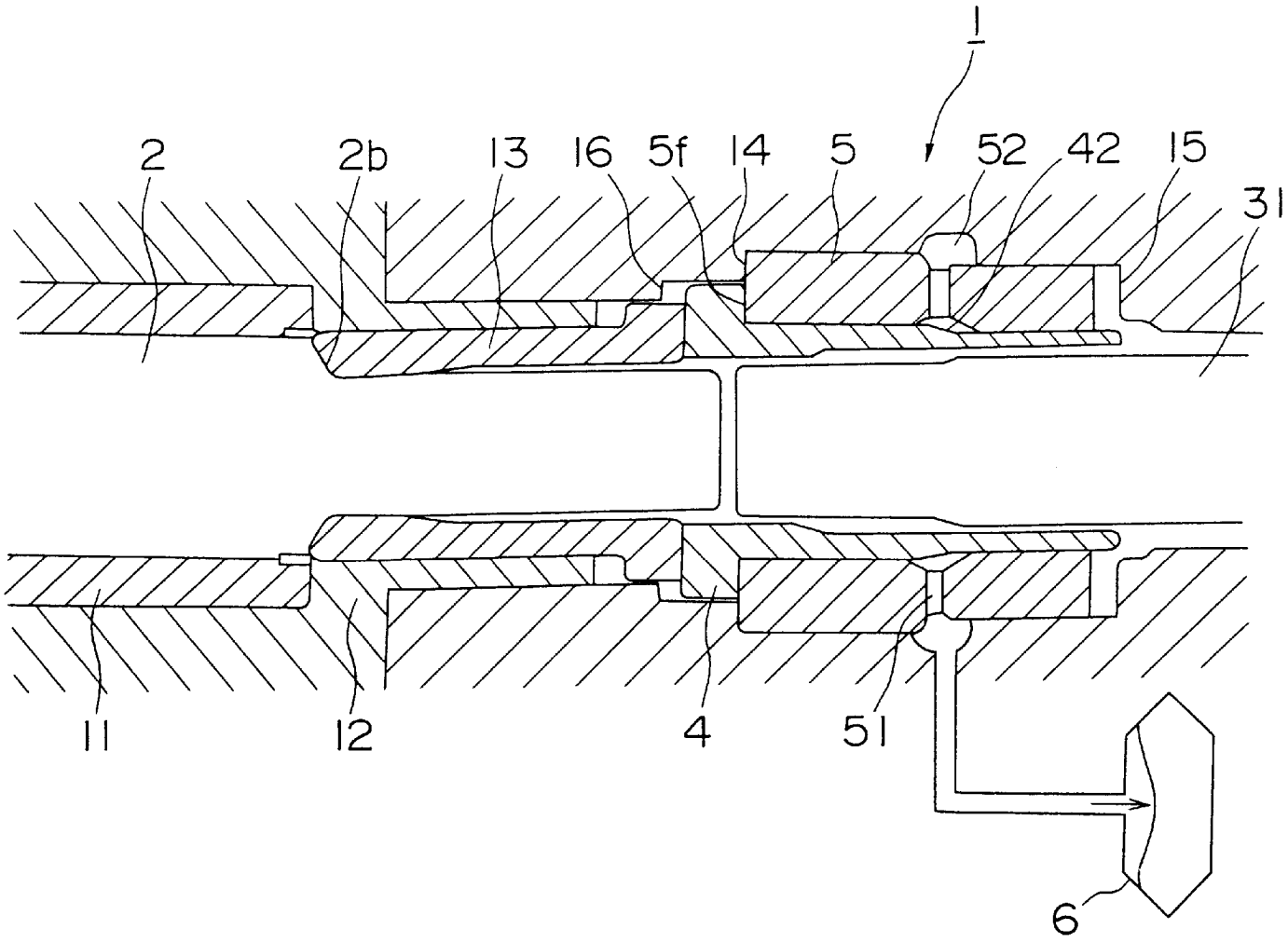
FIG. 1 is a longitudinal sectional view of a buffer mechanism of a rock drill showing one mode of the present invention.

As shown in FIG. 1, the rock drill main body 1 is provided with a chuck driver 12 to rotate the shank rod 2 through a chuck 11, and the chuck driver 12 has fitted thereinto a chuck driver bush 13 which abuts against a large diameter portion rear end 2*b* of the shank rod 2. A front damping piston 4 and a rear damping piston 5 are provided at a rear side of the chuck driver bush 13 to constitute a buffer mechanism.

The rear damping piston 5 is a cylindrical piston which has an oil path 51 to communicate an outer side with an inner side, and the rear damping piston 5 is mounted slidably movable back and forth between a center step portion 14 and a rear step portion 15 formed in the rock drill main body 1, and is applied with forward thrust by oil pressure of a rear damping piston oil chamber 52.

The front damping piston 4 is a cylindrical piston having a large outer diameter at a front end portion and a small diameter at its rear portion, and the small diameter portion is inserted into the rear damping piston 5 slidably movable back and forth, and a range of movement back and forth is limited between a front step portion 16 formed in the rock drill main body 1 and a front end face 5*f* of the rear damping piston 5. A front damping piston oil chamber 42 is formed between an outer peripheral surface of the front damping piston 4 and an inner peripheral surface of the rear damping piston 5, and its oil pressure applies thrust forwardly to the front damping piston 4.

The front damping piston oil chamber 42 is communicated with the rear damping piston oil chamber 52 and with the oil path 51, and the rear damping piston oil chamber 52 is communicated with an accumulator 6 for buffering.

Figure 3:
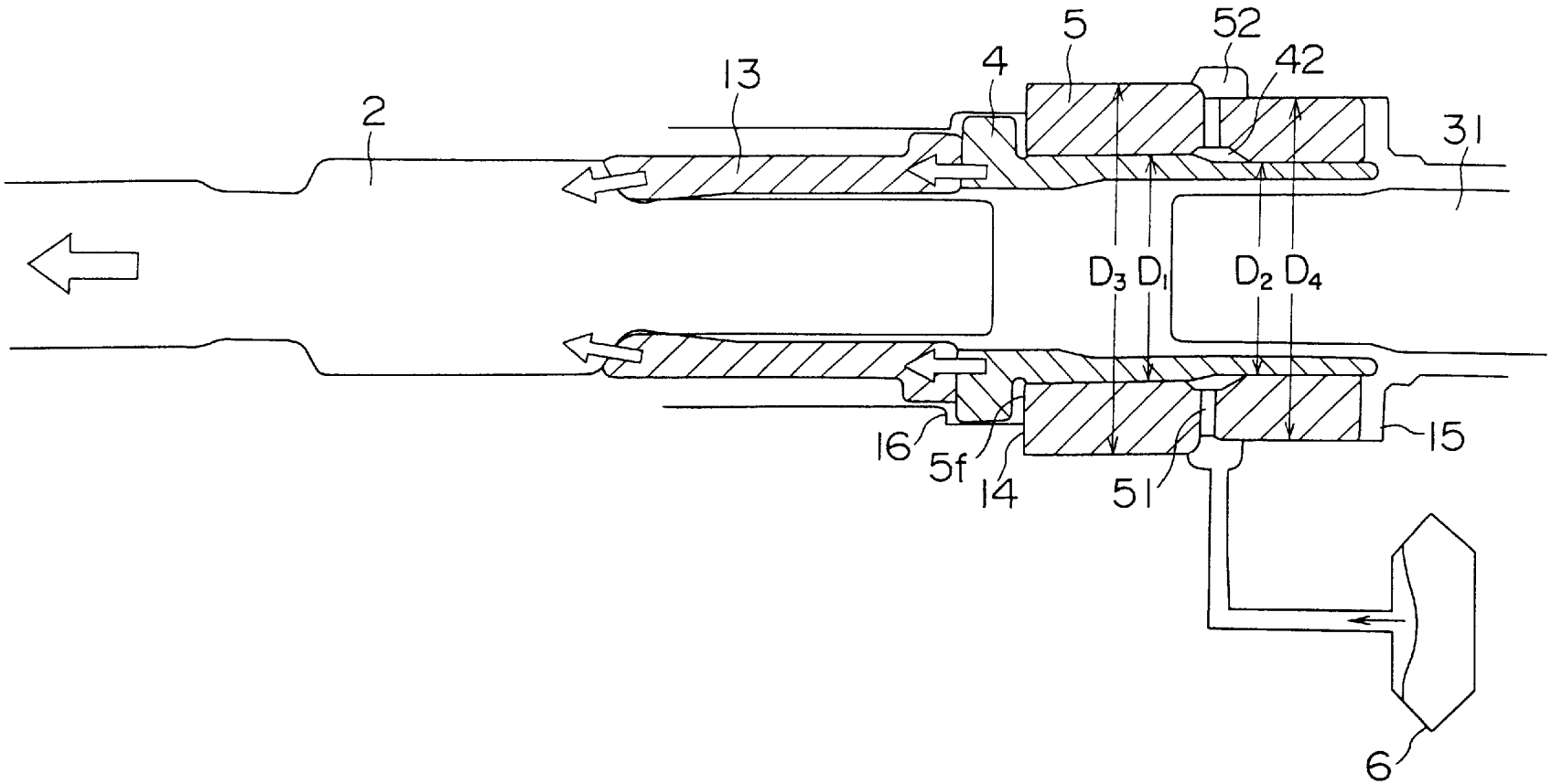
FIG. 3 is a diagram for explaining an operation of the buffer mechanism.

The outer diameter of the front damping piston 4, as shown in FIG. 3, is D1 at the front portion of the front damping piston oil chamber 42, and is D2 at the rear portion, and assuming that the oil pressure of the front damping piston oil chamber 42 is P, the thrust F4 applied to the front damping piston 4 by the oil chamber 42 is expressed by $$F4=\pi(D_1^2-D_2^2)P$$

The outer diameter of the rear damping piston 5 is D3 at the front portion of the rear damping piston chamber 52, and is D4 at the rear portion, and since the oil pressure of the rear damping piston oil chamber 52 is equal to the pressure P of the front damping piston chamber 42, the thrust F5 applied to the rear damping piston 5 by the oil chamber 52 is expressed by $$F5=\pi(D_3^2-D_4^2)P$$

Here, assuming that the thrust F1 is applied by the oil chamber 52 to the rock drill main body 1, it is set to satisfy the following relationship $$F4<F1<F5$$

Normally, the thrust F1 applied to the rock drill main body 1 is about 1 ton, and in the case of high impact specification, it is larger than 1 ton. The ratio of the thrust is set in the following relationship $$F4:F1:F5=1:2:3$$

In the rock drilling work, when the impact poston 31 of the impact mechanism 3 strikes the shank rod 2, the impact energy is transmitted from the shank rod 2 to the bit 21 through the rod 22, and the bit 21 strikes and crushes the rock R which is the object to be cruched.

The reflected energy Er at this time is transmitted to the front damping piston 4 and rear damping piston 5 through the rod 22, shank rod 2, and chuck driver bush 13, and the rear damping piston 5 which has been at a referernce position abutting against the center step portion 14 of the rock drill main body 1 is retracted together with the front damping piston 4 while being buffered by the oil pressure in the rear damping poston oil chamber 52 to a position at which the rear damping piston 5 abuts against the rear step portion 15, so that the reflected energy Er is transmitted to the rock drill main body 1.

In this manner, since the the reflected energy Er transmitted to the chuck driver bush 13 from the shank rod 2 is buffered by the retraction of the front damping piston 4 and rear damping piston 5, the damage of the rock drill main body 1 as well as the bit 21, rod 22 and shank rod 2 is reduced.

The rock drill main body 1 is once retracted by the reflected energy Er transmitted thereto. Since the thrust F5 applied to the rear damping piston 5 by the rear damping poston oil chamber 52 is larger than the thrust F1 applied to the rock drill main body 1, the rear damping piston 5 pushes back the front damping piston 4, the chuck driver bush 13, and shank rod 2, and advances and stops at the reference position at which the front end face 5*f* of the rear damping piston 5 abuts against the center step portion 14 of the rock drill main body 1.

The time T required for a stationary object having mass M to move a distance S by an external force F exerted thereto, assuming that an acceleration is a, is expressed accordding to the equation of motion as follows:

$$F=aM$$

$$S=aT^2/2$$

thus $$T=(2MS/F)^{1/2}$$

Generally, the mass M1 of the rock drill main body 1 is 10 to 30 times as large as the total mass M2 of the front damping piston 4, chuck driver bush 13, shank rod 2, sleeve 23, rod 22, and bit 21, whereas the thrust F1 of the rock drill main body 1 is only about two times as large as the thrust F4 of the front damping piston 4 as stated earier.

The ratio between the time T1 required for the rock drill main body 1 to move the distance S and the time T2 reqired for the front damping piston 4 to move the distance S while pushing the chuck driver bush 13, shank rod 2, sleeve 23, rod 22, and bit 21 is expressed as follows:

assuming that $$M1=20M2$$

$$F1=2F4$$

then $$T1/T2=(10)^{1/2}=3.16$$

Accordingly, the front damping piston 4, after the rear damping piston 5 has stopped, as shown in FIG. 3, moves away from the rear damping piston 5 and advances until the bit 21 reaches the rock R while pushing the chuck driver bush 13 and shank rod 2 faster than the advancement of the rock drill main body 1.

Following this, the rock drill main body 1 advances by one crush length of one impact due to the thrust F1 applied thereto. After the bit 21 reaches the rock R, since the thrust F1 is larger than the thrust F4 of the front damping piston 4, the front damping piston 4 is pushed back until the front damping piston 4 abuts against the rear damping piston 5.

Then the impact mechanism 3 performs the next application of impact. The drilling work is carried out by repeating this stroke.

Even when the reflected energy Er is abnormally large and the advance of the rock drill main body 1 is delayed, since the bit 21 is in contact with the rock R due to the advance of the front damping piston 4, the impact energy is consumed for crushing without fail, and the impact efficiency is improved.

Since the abnormal, reflected energy Er is not generated when the impact energy is consumed for crushing, the retraction of the rock drill main body 1 becomes small, and thereafter, normal advance can be ensured.

In the impact mechanism 3, in order to obtain strong impact energy, the acceleration for advance of the impact piston 31 must be increased, and the collision speed must be made fast. The reaction force which accompanies the acceleration for advance of the impact piston 31 is received by the rock drill main body 1. Since this reaction force is generated before the impact timing, it is desired that the reaction force is smaller than the thrust applied to the rock drill main body 1. If this reaction force is larger than the thrust of the rock drill main body 1, the rock drill main body 1 will receive an acceleration force in the retracting side during the time period in which the reaction force is generating, and the rock drill main body 1 will be slightly retracted before application of impact, even when the bit 21 has already advanced to a position in contact with the rock R. Even in this case, by virtue of the advance of the front damping piston 4, it is possible to hold the bit 21 at the position in contact with the rock R.

In the case, where the tip end portion of the bit 21 encounters a clay layer or a cavity which does not require large impact force, and the bit 21 and rod 2 are advanced by the thrust F4 of the front damping piston 4, the impact piston 31 applies impact on the shank rod 2 at an impact applying position at which the shank rod 2 is pushed forward by the front damping piston 4 beyond the reference position shown in FIG. 1.

Figure 4:
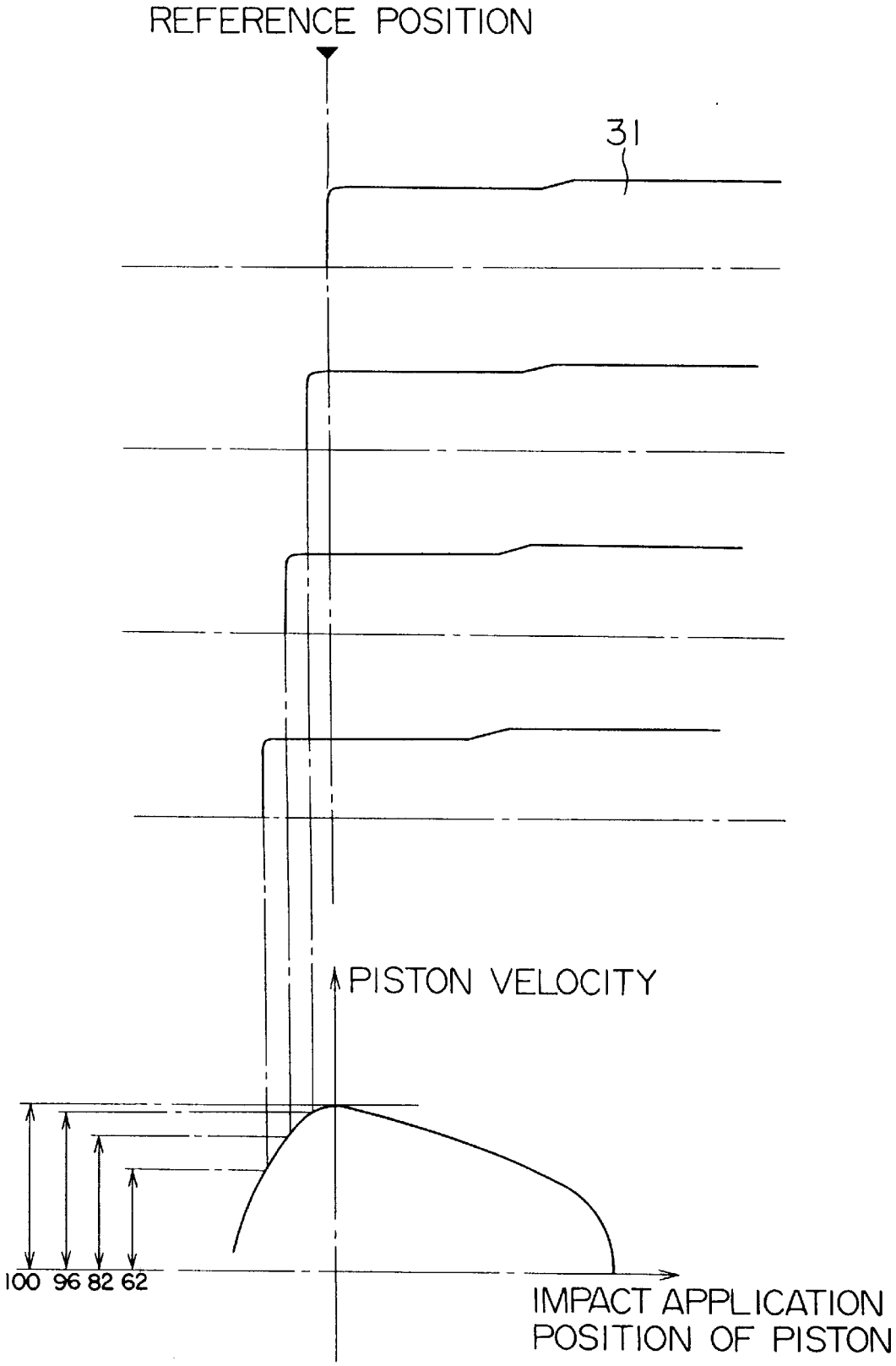
FIG. 4 is a diagram for explaining a relation between an impact application position and a piston velocity.

At this impact position, as shown in FIG. 4, the impact piston 31 is in a deceleration region, and since the piston speed is reduced and the impact force is reduced to light impact, it is possible to drill with an impact force suitable for weak portion such as clay layer or the like.

Figure 5:
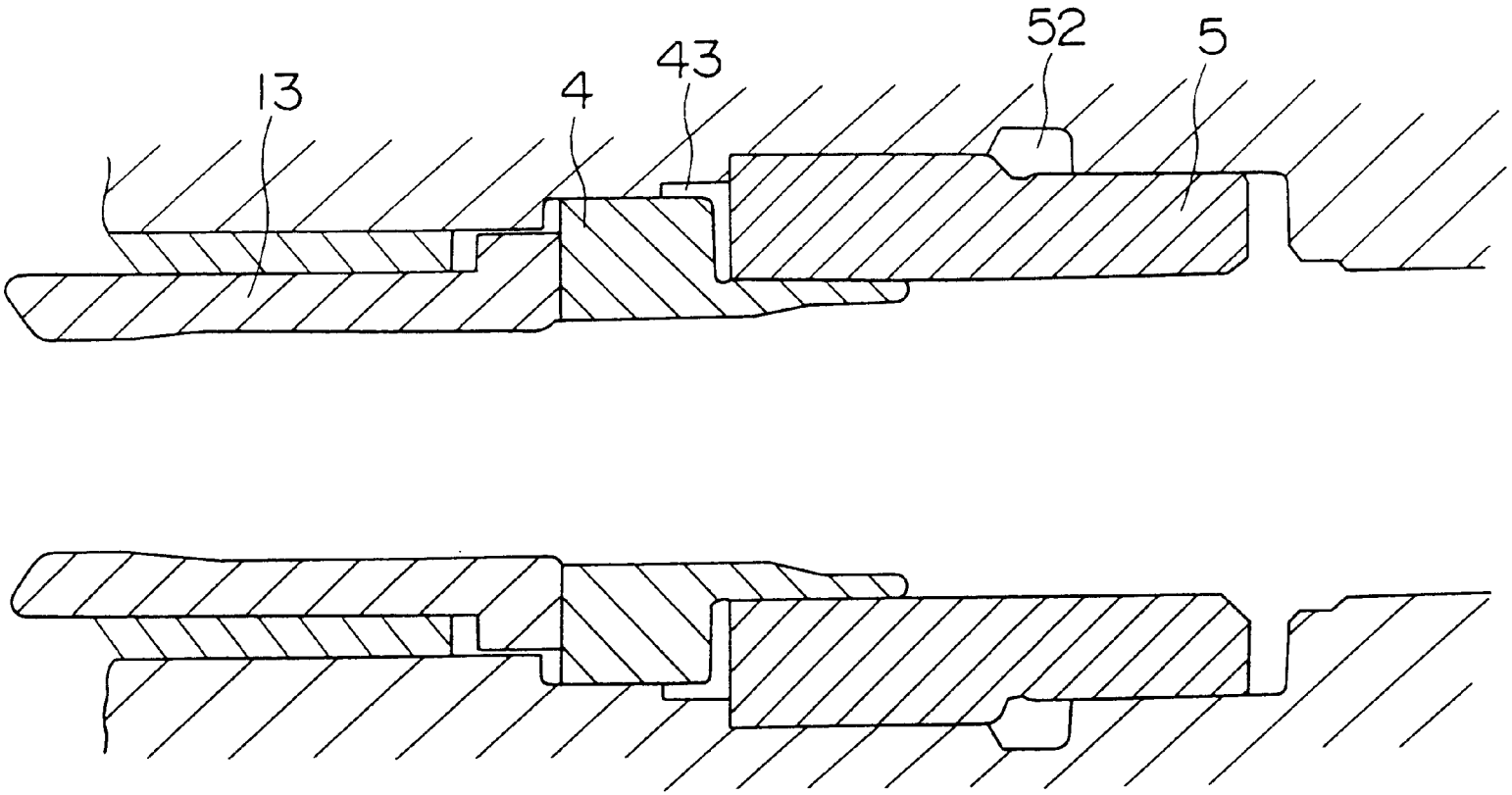
FIG. 5 is a longitudinal sectional view of the buffer mechanism showing another embodiment of the present invention.
Figure 6:
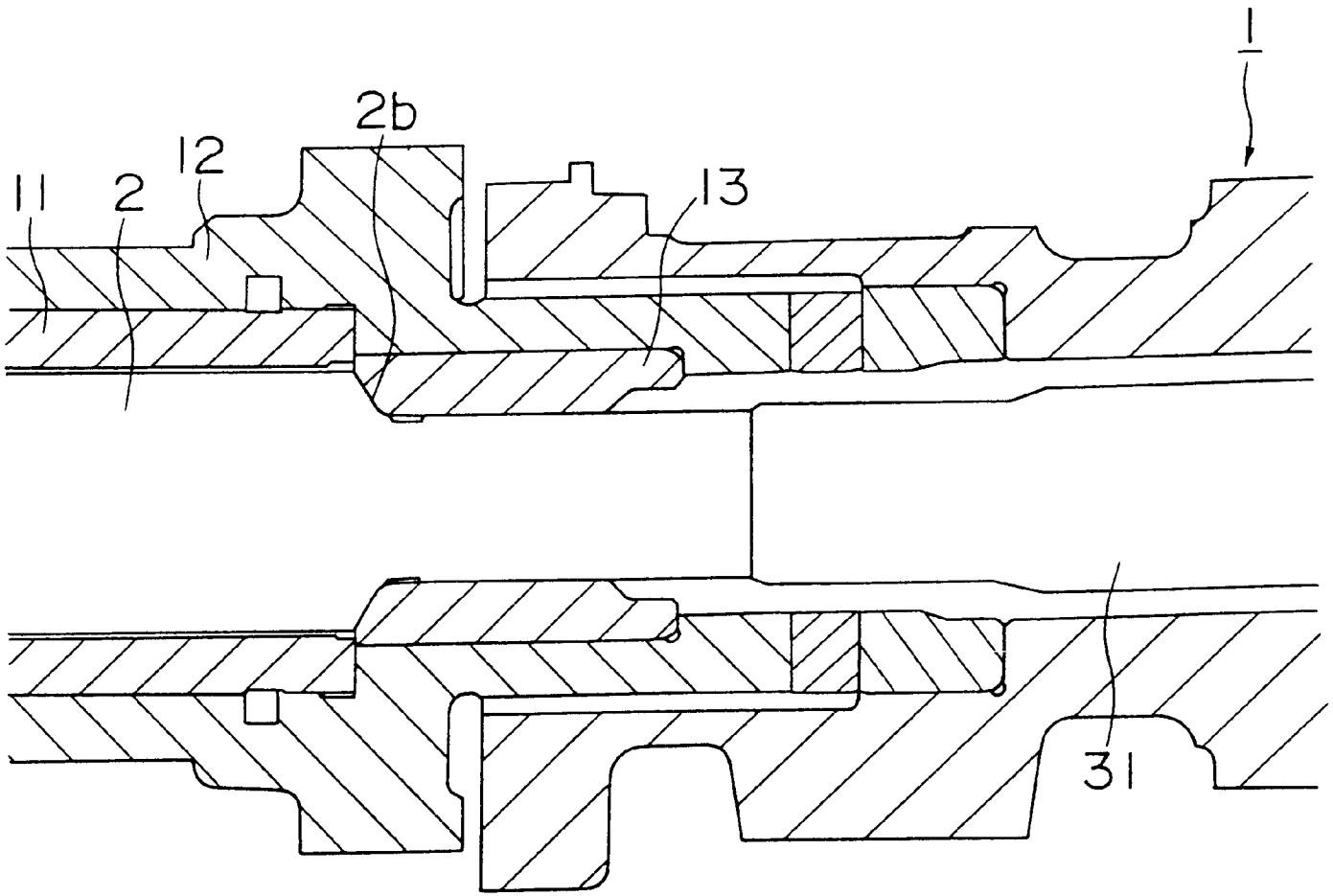
FIG. 6 is a diagram for explaining an internal structure of a conventional rock drill.
Figure 7:
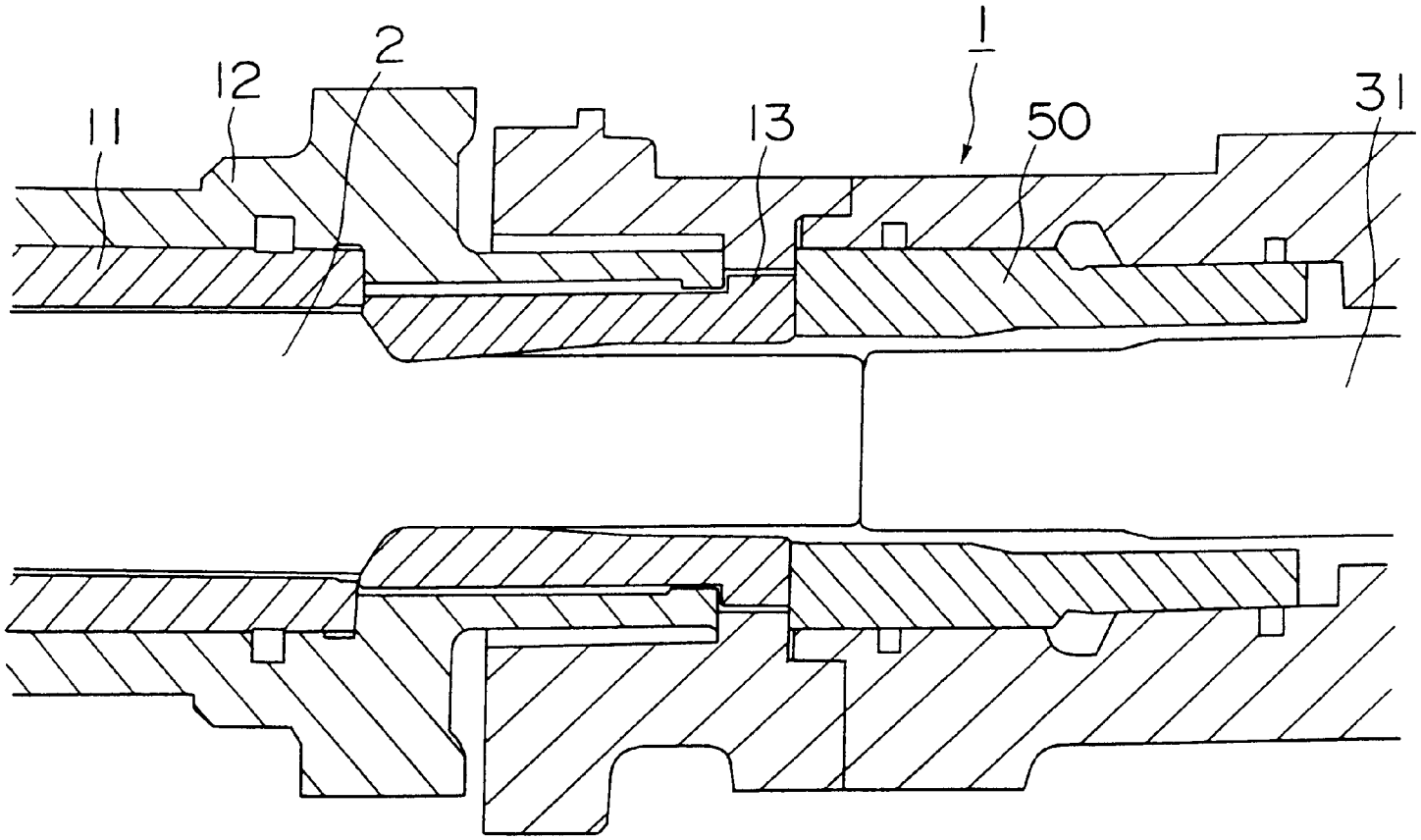
FIG. 7 is a diagram for explaining an internal structure of a conventional rock drill.
Figure 8:
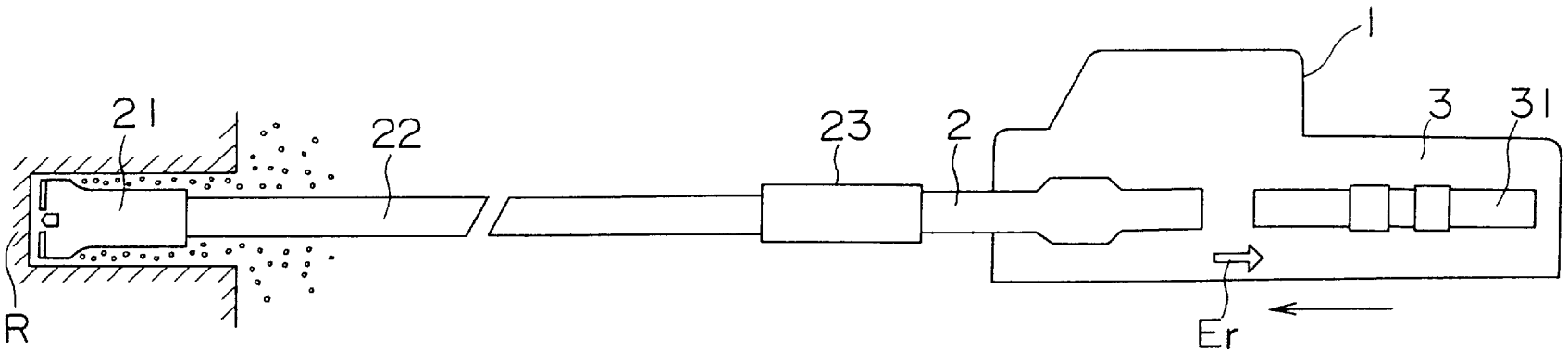
FIG. 8 is a diagram for explaining an operation of the conventional rock drill.

FIG. 5 is a longitudinal sectional view showing another embodiment of the buffer mechanism of the hydraulic impact apparatus of the present invention. In this embodiment, a front damping piston air chamber 43 is formed in place of the front damping piston oil chamber 42 between the front damping piston 4 and the rear damping piston 5, so that an air pressure for blowing is utilized for the thrust of the front damping piston 4.

Exploitation in Industry

As described in the foregoing, the buffer mechanism of the hydraulic impact apparatus of the present invention is suitably utilized for a rock drill, a breaker, and the like for crushing rock, and the like by applying impact to a tool such as a rod, a chisel, etc.

I claim:

1. A hydraulic impact apparatus comprising an impact mechanism for applying impact to a tool, and a transmission member for transmitting thrust to the tool to further apply to a crushing object side, characterized by: a front damping piston having thrust smaller than thrust of an apparatus main body of the hydraulic impact apparatus, and a rear damping piston having thrust larger than the thrust of the apparatus main body.

* * * * *